United States Patent [19]

Hamilton et al.

[11] Patent Number: 4,489,678

[45] Date of Patent: Dec. 25, 1984

[54] APPARATUS FOR THE CONVERSION OF ENERGY

[75] Inventors: Raoul Hamilton, Ovesholms gods, S-291 92 Kristianstad; Lars E. Sehlin; Sten Å. Svensson, both of Tollarp, all of Sweden

[73] Assignee: Raoul Hamilton, Kristianstad, Sweden

[21] Appl. No.: 486,232

[22] Filed: Apr. 18, 1983

[30] Foreign Application Priority Data

Apr. 20, 1982 [SE] Sweden ..... 8202474

[51] Int. Cl.[3] ..... F22B 3/06; F24C 9/00

[52] U.S. Cl. ..... 122/26; 126/247

[58] Field of Search ..... 126/247; 122/26; 237/12.1, 12.3 B, 59; 138/38, 44

[56] References Cited

U.S. PATENT DOCUMENTS 4,256,085 3/1981 Line ..... 126/247

4,370,956 2/1983 Moser et al. ..... 126/247 X 4,388,915 6/1983 Shafran ..... 126/247

*Primary Examiner*—Randall L. Green

*Attorney, Agent, or Firm*—Burns, Doane, Swecker & Mathis

[57] ABSTRACT

An apparatus for the conversion of mechanical energy or kinetic energy into heat, comprising a hydraulic pump (1) for supplying energy to a hydraulic liquid under pressure build-up, and an energy transformer (3) to which hydraulic liquid is supplied which liquid is heated in the energy transformer, and means (d, b) to recirculate the hydraulic liquid after release of heat to the pump (1). The energy transformer (1) includes a casing (9) having at least one inlet (15) and at least one outlet (17) for the hydraulic liquid and velocity increasing means or friction-generating restrictions (19, 21, 31) arranged between said inlet and outlet, whereby the kinetic or mechanical energy of the hydraulic liquid is converted into heat energy.

11 Claims, 3 Drawing Figures

APPARATUS FOR THE CONVERSION OF ENERGY

The present invention relates to an apparatus for the conversion of mechanical energy or kinetic energy into heat.

With rapidly increasing energy costs the energy problems have entered more and more into focus. In this situation the interest has been directed to new systems and devices for the conversion of different energy forms into each other. For example for conversion of electric energy to water-born heat electric resistances are most usually used from which the heat is transferred to the water. This procedure is slow and dependent on the rate of transfer of heat from the electric resistances to the water. A given quantity of water may thus by using such a system be supplied only with a certain limited heat quantity per unit of time since otherwise the electric resistances will not be able to release their heat to the water which can result in complications, for example melting, fire or the like.

Thus, there is a demand for a simple system for conversion of electric, mechanical or kinetic energy into heat.

Accordingly, the present invention has for its purpose to provide an apparatus for the conversion of energy through which kinetic or mechanical energy can be converted into heat in an efficient manner. The invention is based on the utilization of a hydraulic pump through which a hydraulic liquid is supplied with energy under pressure build-up. This mechanical energy or kinetic energy in the hydraulic liquid is then by means of an energy transformer converted into heat, the hydraulic liquid after release of heat being recirculated to the hydraulic pump. The apparatus according to the invention is characterized thereby that the energy transformer includes a casing having at least one inlet and at least one outlet for the hydraulic liquid and velocity increasing means arranged between inlet and outlet, whereby the kinetic or mechanical energy of the hydraulic liquid is converted into heat energy.

In a preferred embodiment of the apparatus according to the present invention the casing is circularly and cylindrically designed and provided with an axially arranged inlet at one end of the casing, the outlet being radially arranged at the other end of the casing.

The apparatus according to the invention is suitably provided with a centrally positioned, axially extending perforated tube which extends from the inlet to the outlet and the perforations of which communicate with radial passages which on the inside of the casing open into an annular gap in turn connecting with the outlet. The apparatus suitably contains washers which are positioned on the central tube and which are arranged adjacent to each other and provided on the side surfaces thereof with radial grooves forming the said radial passages.

For the purpose of fixation of these washers on the central tube each washer is suitably provided with at least one peripheral recess which is arranged to cooperate with an axially extending bar arranged on the inside of the casing.

In a preferred embodiment of the apparatus according to the invention the casing is provided with an axially arranged inlet and several radial outlets, each washer being provided with a plurality of radially arranged grooves which are uniformly distributed and are present in a number corresponding to the number of radial outlets. The radial passages may be formed by grooves arranged on one side of the washers or may be formed of juxtapositioned grooves on both sides of the washers. Each washer may suitably be provided with several recesses distributed over the periphery which cooperate with the corresponding number of bars on the inside of the casing.

For utilization of the heat energy generated in the hydraulic liquid there may be used a heat exchanger, the heat being transferred to a secondary medium, for example water, for use in heating, for example through a radiator. Any suitably conventional type of hydraulic liquid can be used in the apparatus according to the invention and a particularly preferred hydraulic liquid is some sort of oil.

The hydraulic pump can be of any design as long as it has the capability of supplying to the hydraulic liquid the energy necessary for the heat generation.

The invention will in the following be further described through a preferred embodiment of the apparatus which, however, must not be considered as limiting. The description of this embodiment is done in connection with the appended drawing, wherein.

Figure 1:
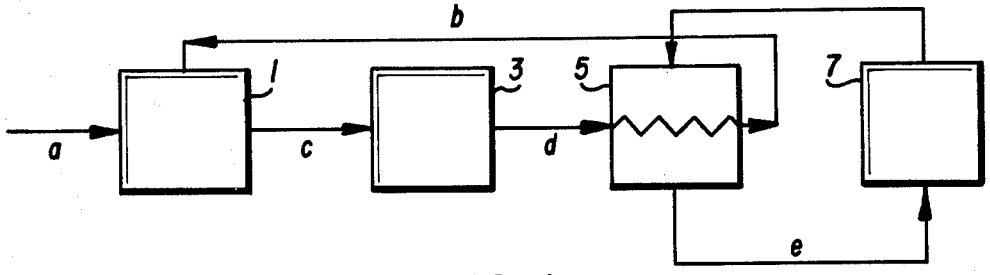
FIG. 1 shows a diagrammatic scheme on a plant, wherein the apparatus according to the invention is utilized.

In the diagrammatic presentation of FIG. 1 there is shown a hydraulic pump 1 which is supplied with kinetic energy at arrow a, for example by means of an electric motor. The hydraulic liquid of the hydraulic pump is after energy input therein in pump 1 transferred via a conduit c to an energy transformer 3 according to the invention, wherein the mechanical energy or kinetic energy is converted into heat. The heated hydraulic liquid is transferred through conduit d to a heat exchanger 5, the energy content of the hydraulic liquid being transferred to a medium, for example water, circulating in a closed system e so as to release its heat at a site of consumption, for example a radiator. After release of the heat in heat exchanger 5 the hydraulic liquid is recirculated to the hydraulic pump 1 via a conduit b.

Figure 3:
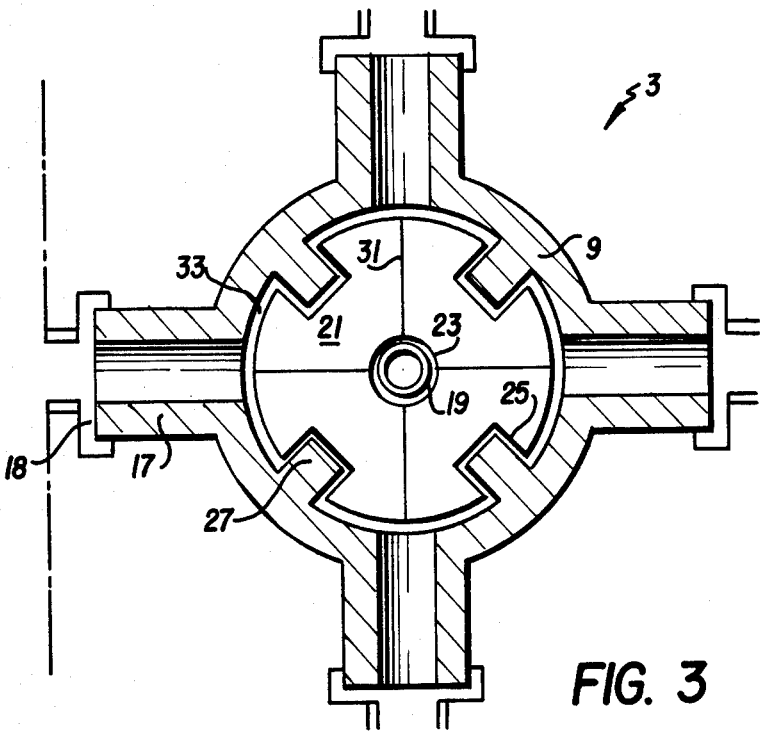
FIG. 3 shows a section along the line A—A in FIG. 2.
Figure 2:
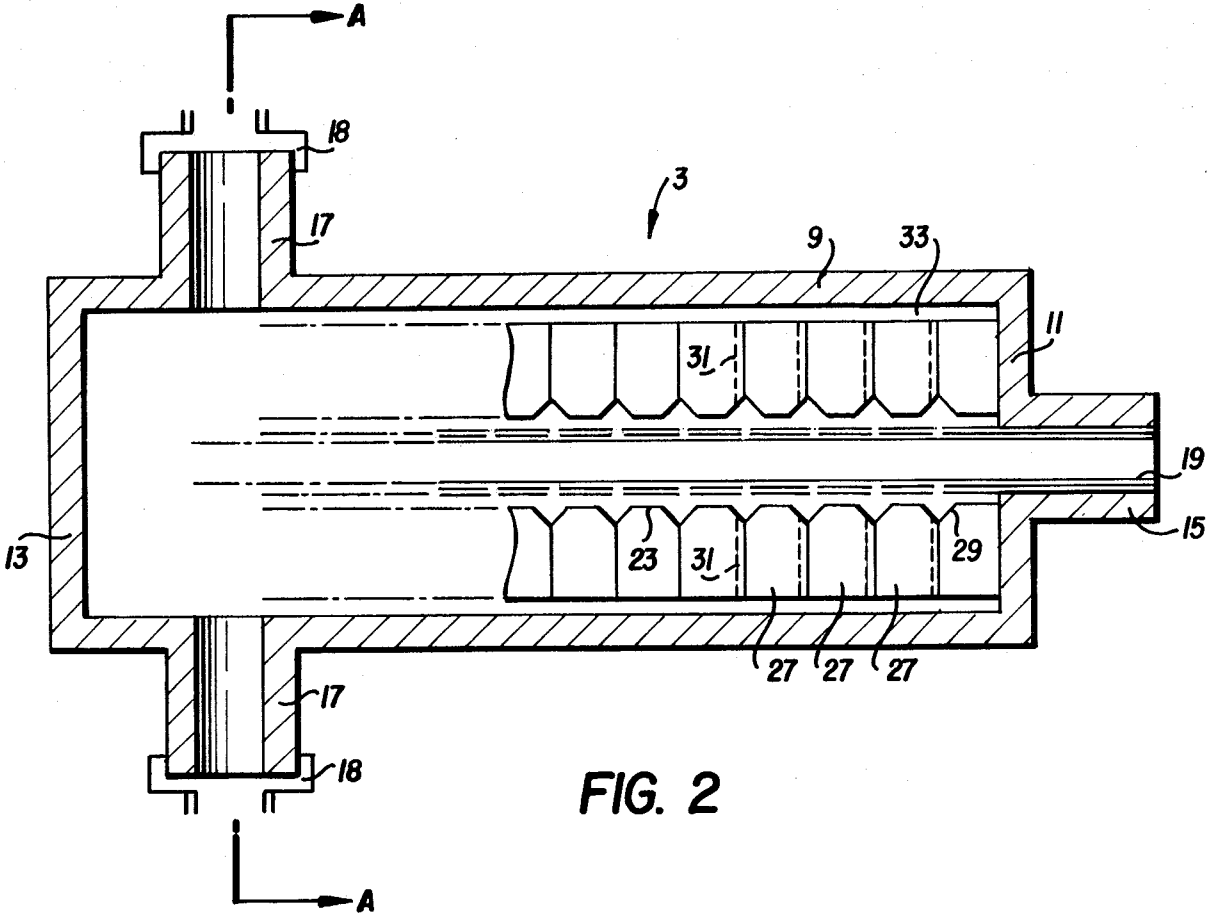
FIG. 2 shows an axial cross section through an energy transformer defined in accordance with the invention.

In FIGS. 2 and 3 the energy transformer generally designated 3 is shown more in detail. The energy transformer 3 includes a circular cylindrical housing or casing 9 provided with end walls 11, 13 which are attached in a manner not disclosed in the drawing. One end wall, for example end wall 11, is detachably mounted for dismantling and assembly.

In the embodiment shown apparatus 3 is provided with an axial inlet 15 arranged in end wall 11. Moreover, it is provided with four radially directed outlets 17 adjacent to the second end wall 13. For connection to conduits each of outlets 17 is provided with a connecting member 18.

Through the whole of casing 9 a central axially extending tube 19 runs which is provided with radial apertures or perforations for a purpose to be described below. A number of washers 21 provided with a central opening 23 are arranged on said tube. To provide for fixation against rotation on tube 19 washers 21 are provided with peripheral recesses 25 which, in the embodiment shown, are present in a number of four and which cooperate with axial bars 27 arranged on the inside of the casing. Washers 21 are inwardly chamfered and each of them is provided on the one side thereof with four radial grooves 31 whereby connection is established between inlet 15 and outlets 17 through an annular gap 33 between the outer edges of washers 21 and the axial bars 27. These bars have also for their function to provide a balanced distribution of the hydraulic liquid between outlets 17. Washers 21 are inwardly chamfered and each of them is provided on the one side thereof with four radial grooves 31 whereby connection is established between inlet 15 and outlets 17 through an annular gap 33 between the outer edges of washers 21 and the inside of casing 9.

Even if in FIG. 2 casing 9 has not been shown completely filled with washers 21 all the way up to the left hand wall it should be observed that this has been done solely to simplify the drawing but that in reality casing 9 is filled with washers along all of its length. From this also follows that tube 19 extends all the way up to end wall 13.

Moreover, it should be observed that tube 19 can extend out through end wall 13 in the same manner as at end wall 11 to form two axial inlets. To obtain balance between these two inlets, outlets 17 can be placed in the middle of casing 19. In the embodiment shown in FIG. 2 outlets 17 can be positioned anywhere along the mantle surface of casing 19.

The function of the apparatus described above is briefly the following. By means of the hydraulic pump 1 driven in a suitable manner the energy transformer 3 is supplied through inlet 15, more specifically the central tube 19, with pressurized hydraulic liquid. The hydraulic liquid is forced through the perforations of the central tube 19 into and through the passages formed by the radial grooves 31 on washers 21. In doing so the hydraulic medium is heated through the velocity increase and the friction in the narrow passages between washers 21 so that when leaving through the annular gap 33 for transfer to outlets 17 the temperature of the hydraulic liquid has been substantially increased. The heated hydraulic liquid is then passed on to the heat exchanger 5 (FIG. 1) where it releases its heat to a suitable secondary medium which thereafter through for example a radiator can submit its heat for heating a space in a building or the like. After the heat release the hydraulic liquid is recirculated to the hydraulic pump 1 and is thus part of a closed heat-generating system.

The apparatus described can be used in an efficient manner for converting large quantities of energy into heat without risk for material destruction as is the case in for example heat generation by electric resistance heating. The apparatus is, moreover, cheap in operation and can easily be dimensioned after the heat requirements involved.

The embodiment shown with its four outsets 17 can be connected to four separate secondary systems, but the invention is, of course, not limited to the use of outlets to a number of four.

The energy transformer 3 can be made from any suitable material, preferably metal or metal alloy. Some sort of steel is usually preferred but also other materials are conceivable, for example hard plastics.

We claim:

1. An apparatus for the conversion of mechanical energy or kinetic energy into heat, comprising a hydraulic pump for supplying energy to a hydraulic liquid under pressure buildup and an energy transformer to which the hydraulic liquid is supplied by the pump, conduit means to recirculate the hydraulic liquid after release of generated heat back to the pump, wherein the energy transformer includes a casing of elongated, preferably cylindrical configuration, having at least one inlet axially arranged at one end of the casing and at least one outlet radially extending from the casing for the hydraulic liquid and velocity increasing restrictions for generating friction between said inlet and outlet including a centrally positioned axial tube extending from the inlet and in communication with the outlet and provided with perforations which communicate with radial passages defined by a plurality of washers positioned on said axially extending tube, side surfaces of said plurality of washers provided with radial grooves such that a pair of said washers in juxtapose relationship form said radial passage, an annular gap defined between an inner circumference of said casing and an outer circumferential extent of said washers, wherein each washer is provided with at least one outer peripheral recess cooperating with an axially extending bar arranged on said inner circumference of the casing, whereby the orientation of the grooves will be fixed, said radial grooves in fluid communication with said annular gap so that the kinetic or mechanical energy of the hydraulic fluid is converted into heat energy by passage through said velocity increasing restrictions.

2. An apparatus according to claim 1 characterized thereby that each washer (21) is provided with a plurality of radial grooves (31) uniformly distributed.

3. An apparatus according to claim 2, characterized by a heat exchanger (5), wherein the heat of the hydraulic liquid is transferred to a secondary medium, for example water, for utilization of the heat to for example heating through a radiator.

4. An apparatus according to claim 2, characterized thereby that each washer (21) is provided with a plurality of recesses (25) distributed over the periphery and cooperating with the corresponding number of bars (27) on said inner circumference of the casing.

5. An apparatus according to claim 1, characterized by a heat exchanger (5), wherein the heat of the hydraulic liquid is transferred to a secondary medium, for example water, for utilization of the heat to for example heating through a radiator.

6. An apparatus according to claim 5, characterized thereby that each washer (21) is provided with a plurality of recesses (25) distributed over the periphery and cooperating with the corresponding number of bars (27) on said inner circumference of the casing.

7. An apparatus according to claim 1, characterized thereby that the hydraulic liquid is an oil.

8. An apparatus according to claim 7, characterized thereby that each washer (21) is provided with a plurality of recesses (25) distributed over the periphery and cooperating with the corresponding number of bars (27) on said inner circumference of the casing.

9. An apparatus according to claim 1, characterized thereby that each washer (21) is provided with a plurality of recesses (25) distributed over the periphery and cooperating with a corresponding number of bars (27) on said inner circumference of the casing.

10. An apparatus according to claim 1, characterized thereby that each washer (21) is provided with a plurality of radial grooves (31) uniformly distributed, and that the casing (9) is provided with a corresponding number of radial outlets (17).

11. An apparatus according to claim 1, characterized by a heat exchanger (5), wherein the heat of the hydraulic liquid is transferred to a secondary medium, for example water, for utilization of the heat to for example heating through a radiator.

* * * * *